US011280594B2

(12) United States Patent
Boring

(10) Patent No.: US 11,280,594 B2
(45) Date of Patent: Mar. 22, 2022

(54) REACTIVE FIREARM TRAINING TARGET PROVIDING VISIBLE FEEDBACK

(71) Applicant: Nathan Boring, New Tripoli, PA (US)

(72) Inventor: Nathan Boring, New Tripoli, PA (US)

( * ) Notice: Subject to any disclaimer, the term of this patent is extended or adjusted under 35 U.S.C. 154(b) by 0 days.

(21) Appl. No.: 16/828,689

(22) Filed: Mar. 24, 2020

(65) Prior Publication Data

US 2020/0240754 A1 Jul. 30, 2020

Related U.S. Application Data

(63) Continuation of application No. 16/441,125, filed on Jun. 14, 2019.

(60) Provisional application No. 62/685,949, filed on Jun. 16, 2018.

(51) Int. Cl.
*F41J 5/24* (2006.01)
*F41J 7/04* (2006.01)

(52) U.S. Cl.
CPC .. *F41J 5/24* (2013.01); *F41J 7/04* (2013.01)

(58) Field of Classification Search
CPC ..... F41J 5/24; F41J 7/04; F41J 1/01
See application file for complete search history.

(56) References Cited

U.S. PATENT DOCUMENTS 5,188,371 A * 2/1993 Edwards ..... F41J 1/01 273/378
5,394,824 A * 3/1995 Johnson, Jr. ..... A63B 71/0605 116/203
2004/0140623 A1* 7/2004 Pulkrabek ..... F41J 3/0004 273/408
2010/0087296 A1* 4/2010 Hansen ..... A63B 69/205 482/83
2013/0016415 A1* 1/2013 Kurtz ..... B44F 1/08 359/244
2014/0042700 A1* 2/2014 Baron ..... F41J 1/01 273/408
2019/0301841 A1* 10/2019 Edwards ..... F41J 1/01
2020/0132420 A1* 4/2020 Campbell ..... F41J 5/14

* cited by examiner

*Primary Examiner* — Jeffrey S Vanderveen
(74) *Attorney, Agent, or Firm* — Andrew Morabito

(57) ABSTRACT

A hit-indicating target comprising; a layer of polymer material, having a first side and a second side; and a first coating of thermally activated pigment applied to the first side of the layer of polymer material, wherein the first coating has an activation temperature.

15 Claims, 6 Drawing Sheets

REACTIVE FIREARM TRAINING TARGET PROVIDING VISIBLE FEEDBACK

CROSS-REFERENCE TO RELATED APPLICATIONS

This application is a continuation of U.S. application Ser. No. 16/441,125 filed Jun. 14, 2019 and U.S. provisional patent application No. 62/685,949 filed Jun. 16, 2018. The disclosure of the prior applications is considered part of (and is incorporated by reference in) the disclosure of this application.

BACKGROUND OF THE INVENTION

The present invention relates to a target, and more particularly to a reactive target, and more particularly to a target that provides visual feedback of the point of impact.

The predominant categories of targets for shooting sports generally fall into three categories: paper or cardboard, steel, and self-healing. Each of these target types offers unique advantages and drawbacks.

Paper targets, while simple and inexpensive, offer limited feedback of a hit and often need to be scored or checked on a cold range by physically walking to the target or using a retrieving system in the case of a typical indoor range. Paper targets also have an extremely limited life and must be changed frequently or taped over to hide previous damage and make new strikes obvious.

Reactive targets, for example, steel targets offer audible and/or visual feedback upon a successful hit and are typically very durable, however they must be painted over between shots to allow the precise strike location to be visible. Additionally, bullet impacts on steel targets result in dangerous spatter and fragmentation of the projectile, making them unsuitable for indoor and close-range shooting.

Self-healing reactive targets are relatively durable, produce no spatter, and provide a visual feedback through the motion of the struck target. Due to their polymeric construction, these targets can be produced in nearly limitless shapes. However, these targets make it difficult or impossible to see the precise point of impact since the damage "heals" and sometimes provide insufficient movement to positively detect a hit. Even on close inspection, it may be impossible to determine recent strike locations as the target accumulates more damage.

Therefore, it is desired for a target that addresses all of these shortcomings, providing a durable reactive target that clearly indicates the precise location of a bullet strike and "resets" with no intervention from the shooter or other party.

SUMMARY

A first aspect of the present invention is a hit-indicating target comprising: a layer of polymer material, having a first side and a second side; and a first coating applied to at least the first side of the layer of polymer material, wherein the first coating contains a visual indicating pigment.

The first aspect of the present invention further encompassing wherein the first coating is a reversible thermochromic pigment, wherein the thermochromic pigment has a first activation temperature. Wherein the first coating is a piezochromic material, wherein the first coating has a first activation pressure. Further comprising a second coating of a visual indicating pigment applied to at least the first side of the layer of polymer material, wherein the second coating has a second activation temperature which is a different temperature compared to the first activation temperature of the first coating. Wherein the layer of polymer material has self-healing properties. Wherein the first coating and the second coating are mixed together to form a mixed layer with two distinct activation temperatures applied to the polymer material. Wherein the piezochromic material is reversible. Further comprising a third coating of UV resilient material is applied to the first coating.

A second aspect of the present invention comprising a method to fabricate a hit-indicating target, the method comprising: forming, a self-healing polymer media; and incorporating, a first visual feedback pigment to the polymer media, wherein the first visual feedback pigment has a first activation trigger, wherein the trigger is an activation energy.

The second aspect further comprising applying a UV protective coating to the self-healing polymer media. Wherein the first activation trigger is a predetermined temperature value. Wherein the first activation trigger is a predetermined pressure value. Further comprising applying a second visual feedback pigment to the self-healing polymer media, wherein the second visual feedback pigment has a second activation trigger which is different from the first activation trigger.

A third aspect of the present invention comprising a method to fabricate a hit-indicating target, the method comprising: forming, a self-healing polymer media, wherein the self-healing polymer media is in a predetermined shape; and incorporating, a first reversible visual feedback pigment to the polymer media, wherein the first reversible visual feedback pigment has a first activation temperature.

DETAILED DESCRIPTION OF THE INVENTION

Figure 1:
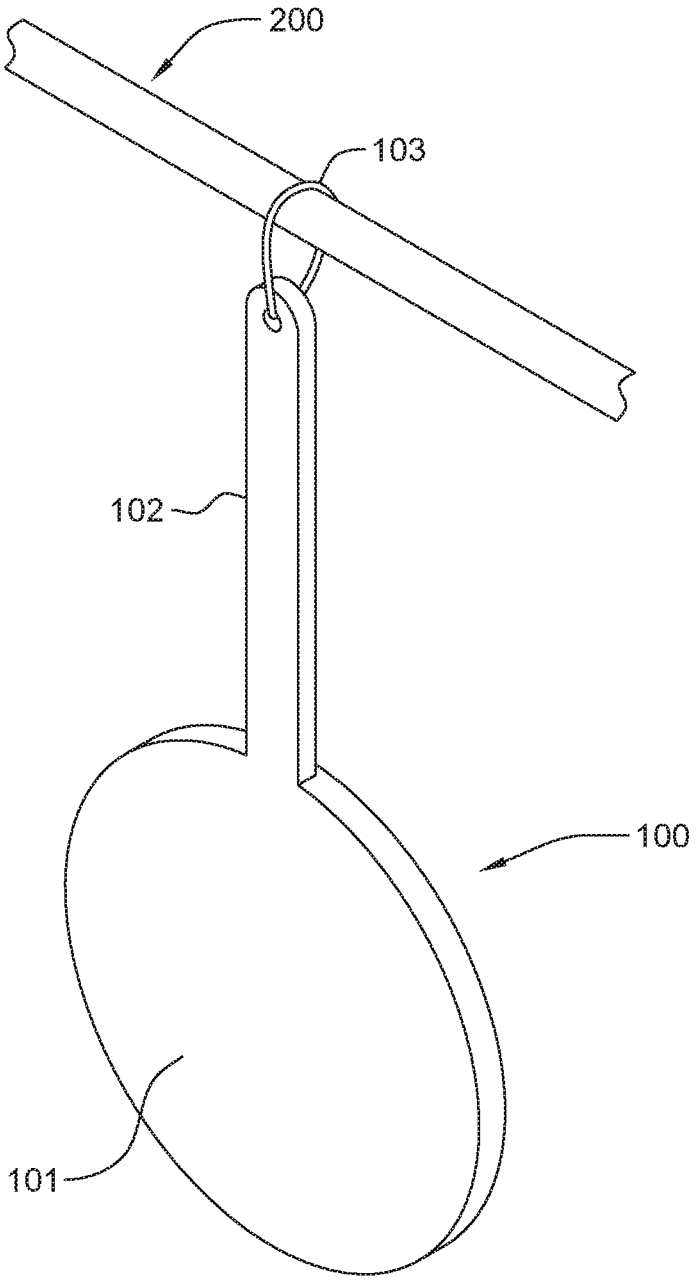
FIG. 1 depicts an image of a target, in accordance with one embodiment of the present invention.

The present invention is a self-healing visual feedback target and provides an improvement upon the self-healing type of target, providing a visual feedback in the material immediately surrounding the point of impact through the use of reversible thermochromic pigment in the construction of the target. Upon penetration of the target, the projectile imparts energy into the target material as the target deforms and then "heals". The projectile may be, but is not limited to a bullet, bb, arrow, and various other forms of ammunition. This energy causes an increase in temperature at the immediate point of impact and some surrounding material, which in turn, causes the incorporated pigment to change color in this area providing an obvious and precise indication of a strike. As the temperature of the impacted area returns to ambient, the pigment returns to the original color, thereby "resetting" the target. Subsequent shots to the same area will cause the same visual effect, dramatically extending the useful life of the target and enhancing its usefulness in providing the shooter with precise feedback on shot placement.

Thermochromic compositions change color in response to temperature fluctuations. Conventional reversible thermochromic compositions exhibit reversible thermochromic properties such that they begin to become color-extinguished in the course of temperature rise caused in a color-developed state, present a completely color-extinguished state at a specific temperature or above, and begin to develop a color in the course of subsequent temperature drop and return to the color-developed state. In some embodiments, the thermochromic composition is a thermochromic paint which uses liquid crystals or leuco dye, which are either applied to the target or are incorporated into the base material of the target. After absorbing a certain amount of heat, the crystallic or molecular structure of the pigment reversibly changes in such a way that it absorbs and emits light at a different wavelength than at lower temperatures.

Given the inherent advantages of a self-healing target, this improved version is ideal for indoor and close-range competition, where bullet fragmentation and spatter of steel targets is unsafe and where paper requires intervention between rounds to tape over or replace targets. The invention is also well-suited to long range shooting, where a pronounced visual impact of a hit is imperative. Furthermore, the automatic "resetting" of the target as the pigment returns to its base color eliminates time-consuming and laborious trips to the target that would be necessary to paint steel targets or tape over or replace paper targets.

The self-healing visual feedback target provides for an advantage of allowing for confirmation of a hit, along with providing a clear visual indication of the precise location of the hit. This advantage provides for a near-instantaneous feedback of any hits on the target. In some embodiments, the self-healing visual feedback target also returns (or reverses) to its original state (e.g. color) once the energy absorbed dissipates from the target. The present invention provides another advantage of using a self-healing or other form of polymer target, so when the target is hit, the visual feedback properties of the target provide the visual indication of the location of the hit, where the resulting hole and/or damage would be otherwise difficult to see, especially at a distance, and the target substantially heals to allow for continuous use without the need to replace the target. It also serves to provide confirmation of a hit when other feedback is insufficient or prior damage masks the holes from immediate strikes.

The visual feedback properties of the target illustrate the point of impact for a short time after the projectile penetrates or hits the target. The additional visual feedback of a "hit" is advantageous to immediately identify if the target was hit and precisely where the target was hit. Typically, a target "reacts" to a hit by either creating a permanent hole, moving (e.g. spinning or rotating), generating a sound (e.g. when hitting a steel target), releasing an encapsulated fluid or dye, or in some cases the target explodes.

Many of these previously designed targets are irreversible and once hit, have to be replaced. Thus, producing a tremendous amount of waste. Further identifying the advantages of the present self-healing visual feedback target.

The self-healing visual feedback target is also useful as a replacement for a traditional paper target, and an improvement on high-visibility laminate targets, especially at long range where point of impact may be difficult to see, where shots are typically taken at a lower frequency, and where target replacement represents significant effort. Given sufficient time between shots, the same target can be reused for an entire shooting session, saving significant effort. Additionally, with a traditional paper target, it is near-impossible to identify if two hits on the target are at substantially the exact same location on the target. The self-healing visual feedback target will clearly indicate a second hit, even when it lands in precisely the same location.

As will be apparent to those of skill in the art upon reading this disclosure, each of the individual embodiments described and illustrated herein has discrete components and features which may be readily separated from or combined with the features of any of the other several embodiments without departing from the scope or spirit of the present invention. It is to be understood that this invention is not limited to particular embodiments described, as such may, of course, vary. It is also to be understood that the terminology used herein is for the purpose of describing particular embodiments only, and is not intended to be limiting, since the scope of the present invention will be limited only by the appended claims.

Unless defined otherwise, all technical and scientific terms used herein have the same meaning as commonly understood by one of ordinary skill in the art to which this invention belongs. Although any methods and materials similar or equivalent to those described herein can also be used in the practice or testing of the present invention, the preferred methods and materials are now described.

All publications and patents cited in this specification are herein incorporated by reference as if each individual publication or patent were specifically and individually indicated to be incorporated by reference and are incorporated herein by reference to disclose and describe the methods and/or materials in connection with which the publications are cited. The citation of any publication is for its disclosure prior to the filing date and should not be construed as an admission that the present invention is not entitled to antedate such publication by virtue of prior invention. Further, the dates of publication provided may be different from the actual publication dates which may need to be independently confirmed.

It must be noted that as used herein and in the appended claims, the singular forms "a", "an", and "the" include plural referents unless the context clearly dictates otherwise. It is further noted that the claims may be drafted to exclude any optional element. As such, this statement is intended to serve as antecedent basis for use of such exclusive terminology as "solely," "only" and the like in connection with the recitation of claim elements or use of a "negative" limitation.

As shown in FIGS. 1-5, the target 100 is shown in various images and through various stages of before, during, and after a hit is registered on the target 100, in accordance with one embodiment of the present invention. Shown in FIG. 1 is the target 100 prior to a hit. The target 100 is shown as a substantially flat disk 101 with a handle 102 for securing the target 100. In the depicted embodiment, the handle 102 is secured to a mount 200 through the use of a fastener 103. In additional embodiment, the handle 102 may be secured directly to the mount 200. In various embodiments, the target 100 may take on a variety of shapes, sizes, and designs. The target 100 surface is shown as a uniform surface with no distinctive markings.

Figure 2:
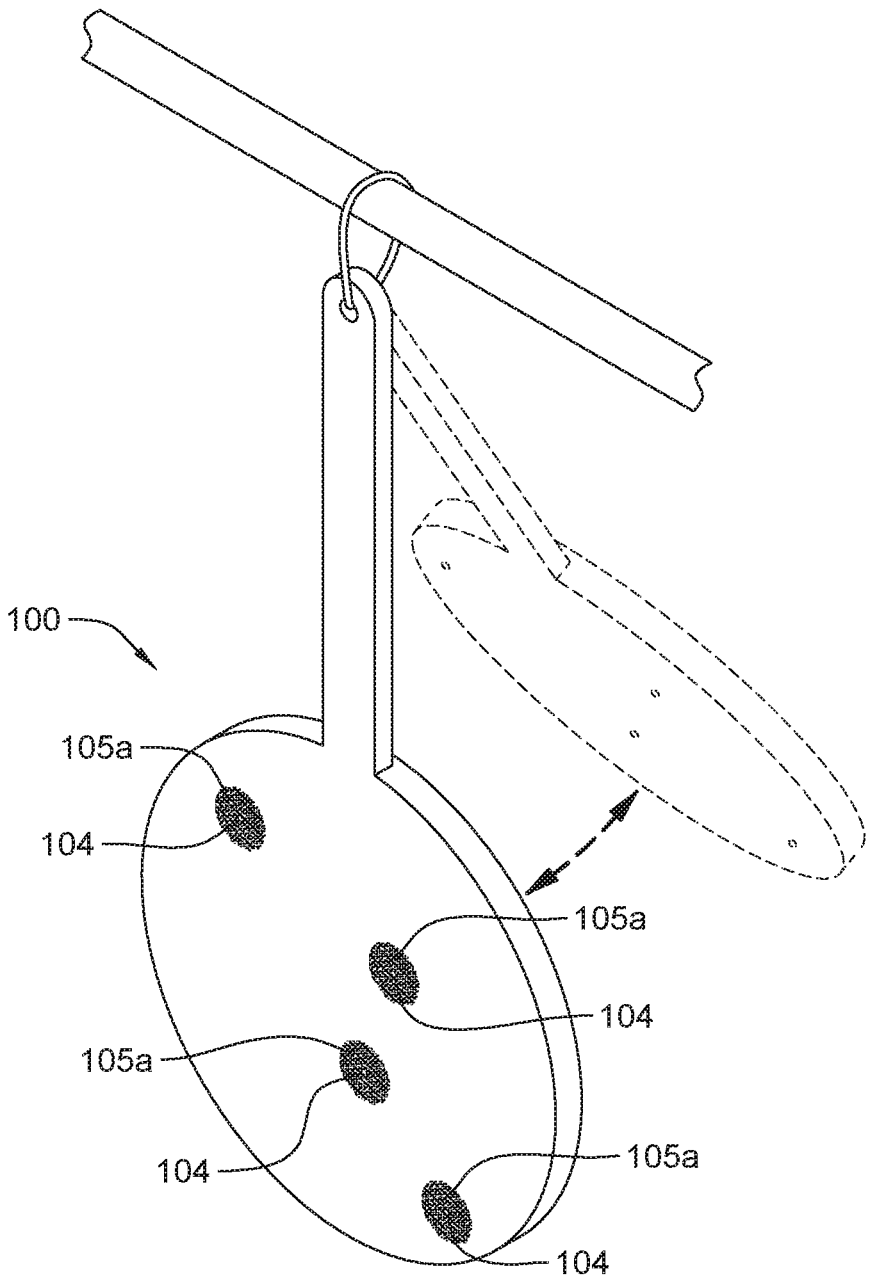
FIG. 2 depicts an image of the target immediately after impact, in accordance with one embodiment of the present invention.

FIG. 2 depicts the target 100 substantially right after a hit by multiple projectiles. The depicted figures show multiple projectile hits at substantially the same time for exemplary purposes. The number of projectiles discharged from the firearm or ranged weapon may vary and provided the projectile(s) hits the target 100 the visual feedback is substantially similar. The projectile, may, but not always, penetrate the target 100. In some embodiments, the target 100 is designed not to allow a projectile to penetrate the target 100. In the depicted embodiment, the projectile penetrated the target 100 at a point of impact 104 and a thermally activated pigment is activated in an area 105 around the point of impact 104. In the depicted embodiment, the point of impact 104 is shown to be visible, however the target 100 is designed to be self-healing based on material used to create the target 100. In some embodiments, the target 100 is made from polyurethane or other known self-healing materials. In the embodiments, where the projectile is able to pass through or enter into the target 100, the material the target 100 is made from, collapse after the projectile has passed through the target 100, to "heal" the opening. The size of the area 105, is based on the thermal energy absorbed or transferred to the target 105 which is affected is based on the size, speed, and energy carried by the projectile as well as environmental factors. For example, the ambient temperature of the environment, the temperature of the target 100, and the humidity of the environment may alter the area 105*a* affected. The activation of the area 105*a* is due to heat/energy that is absorbed by the thermally activated pigment when the projectile comes in contact with the target 100. The area 105*a* remains active for a period of time based on the thermal mass of the target, the ambient temperature and humidity, and the temperature of the target 100 and the properties of the thermally activated pigment.

In the depicted embodiment, the target 100 is shown with the ability to move from its initial position when hit by a projectile. Depending on the mount 200 the target may move back and forth, side to side, or various other directions. This movement of the target 100 based on the mount 200 provides a second form of identification that the target 100 has been hit. Various mounts 200 known to those skilled in the art may be incorporated with the target 100 and the mount 200 shown in the depicted embodiment is for exemplary purposes.

In some embodiments, various portions of the target 100 are coated with, or have incorporated into the target 100 multiple different thermochromic or piezochromic pigments. Thus, a hit to a specific area of the target would activate the pigment of different colors. For example, a target with the classic rings (leading to a bullseye) each ring would have a different color to show a visual indication of which ring was hit. In additional embodiments where the target 100 takes on a shape of an animal or character, various ideal hit areas would have a first activation color, and less desirable areas would have a second activation color.

In further embodiments where different visual feedback pigments with different activation colors are used, some of the visual feedback pigments may be reversible, and some maybe irreversible.

Figure 3:
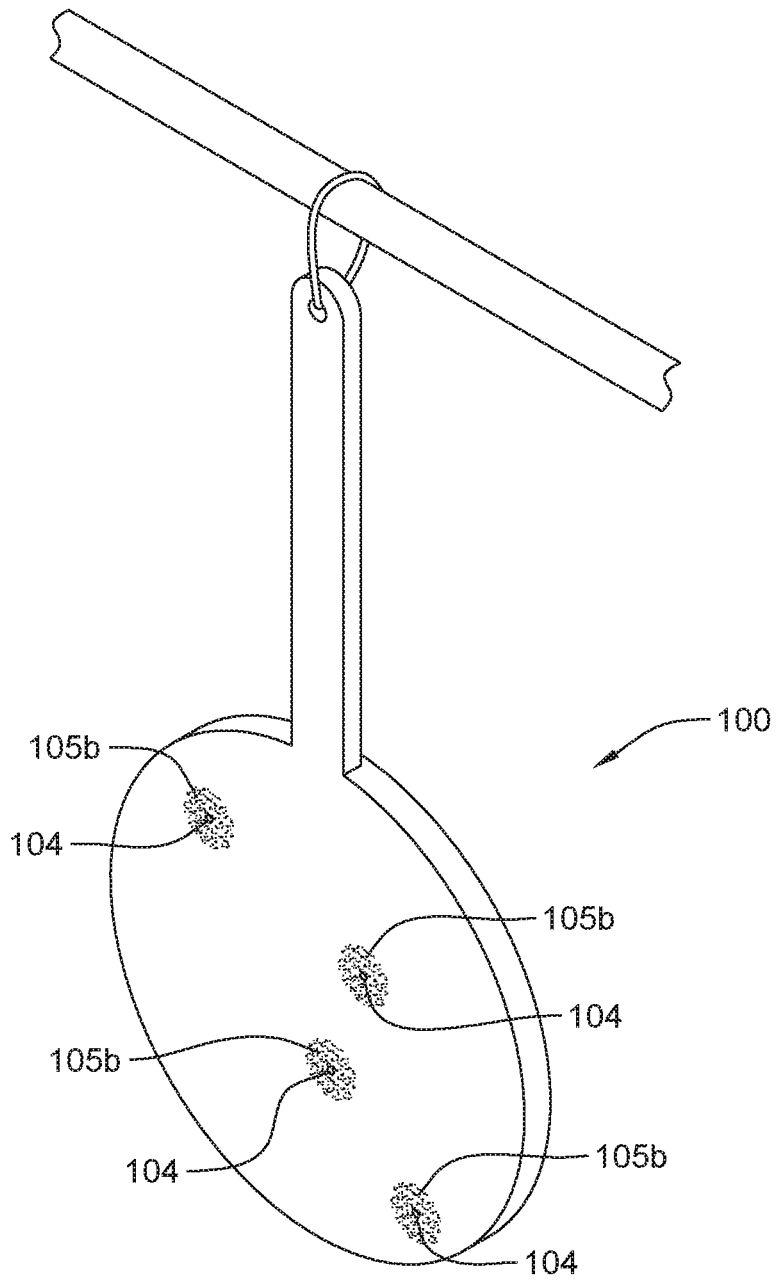
FIG. 3 depicts an image of the target shortly after impact, in accordance with one embodiment of the present invention.
Figure 4:
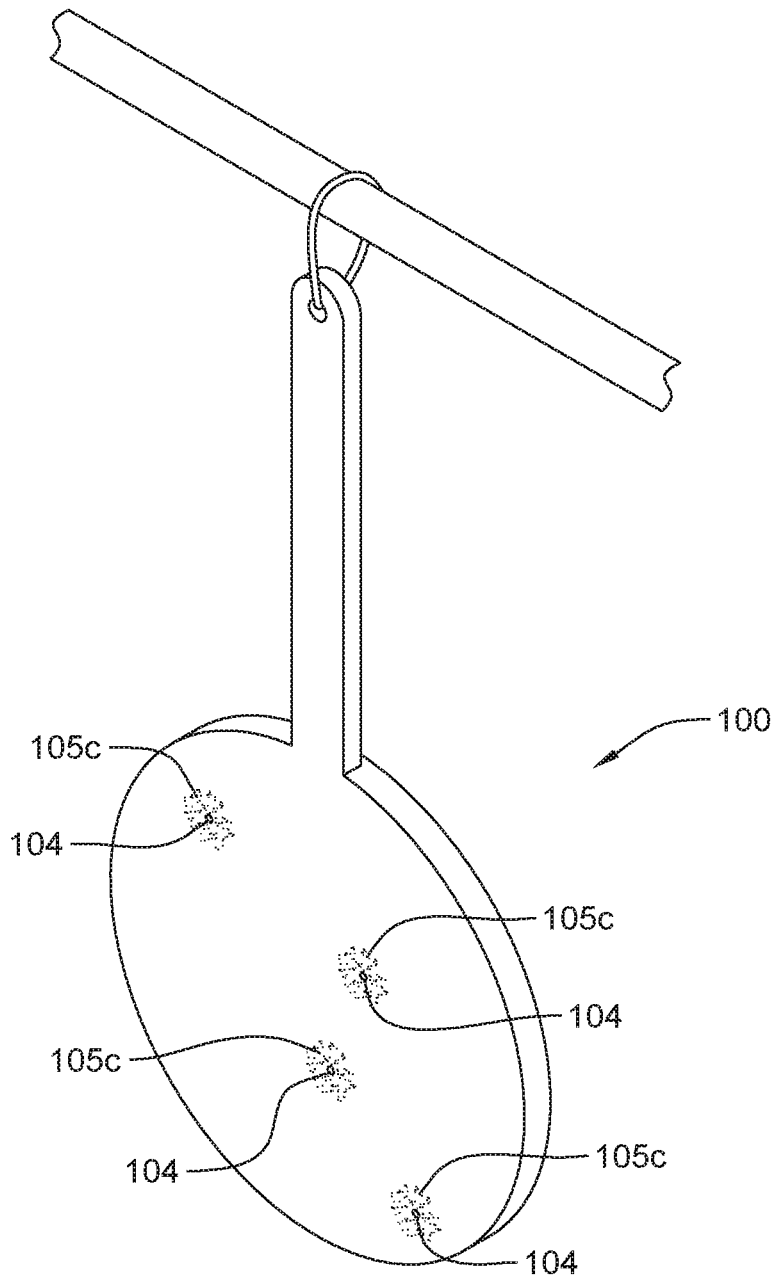
FIG. 4 depicts an image of the target after impact, in accordance with one embodiment of the present invention.

FIGS. 3-4 depicts the target 100 after a period of time since the projectile came in contact with the target 100, were the area 105*b* has begun to return to the target's original color and the area 105*b* has begun to change. FIG. 4 shows the area 105*c* as the target 100 progress further back to its original state, in accordance with one embodiment of the present invention. In the figures, as the target 100 returned to its initial temperature, the area 105 shifts from the activation color back to the initial color. In some embodiments, the initial color may be clear based on the layer of thermally activated pigment. In some embodiments, the pigment changes from a visible color to a colorless. In some embodiments, the area 105 goes through a two- or three-color phase shift based on the type of pigment and layers of pigment used.

Figure 5:
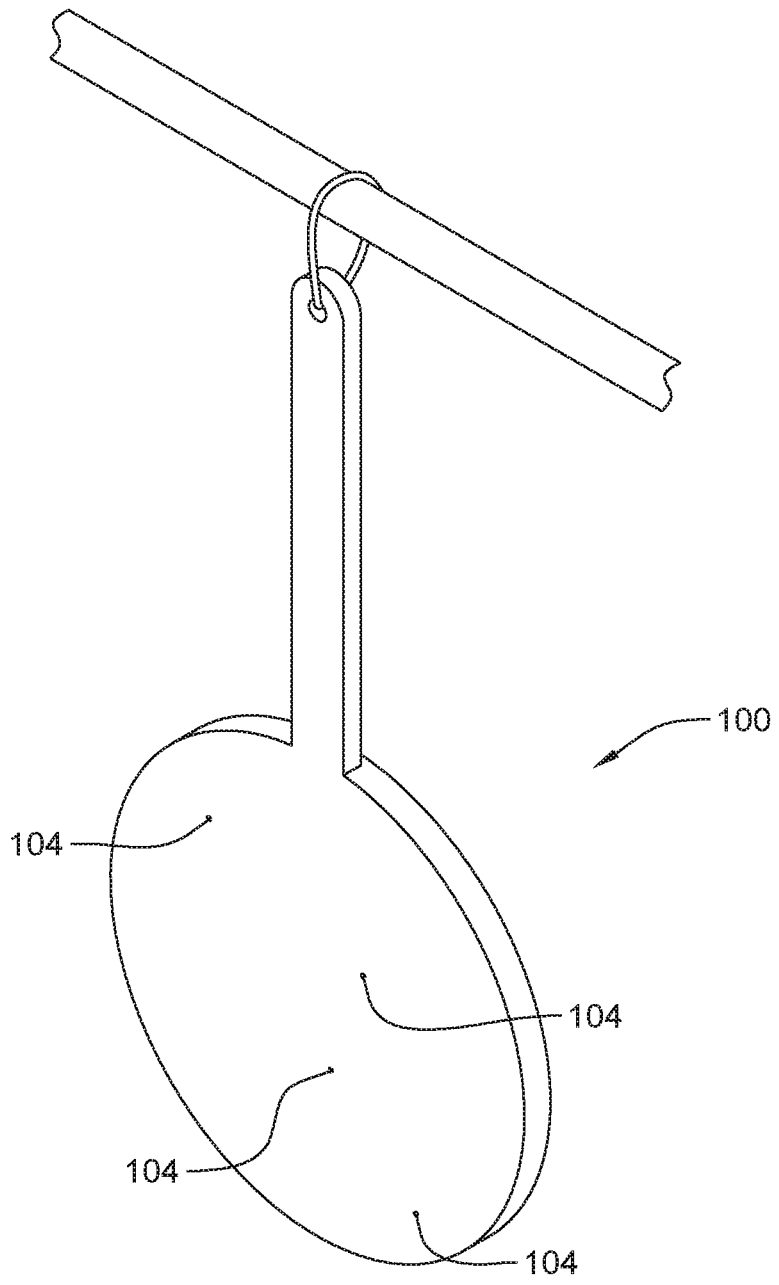
FIG. 5 depicts an image of the target after returning to its original state, in accordance with one embodiment of the present invention.

FIG. 5 depicts an image of the target after returning to its original state, in accordance with one embodiment of the present invention. While the point of impact 104 is still present, if a projectile hit that area again, this new impact would be visible due to the reactivation of the pigment. The target would go through the same process explained above in FIGS. 2-5, as the point of impact 104 would go through the same changes of areas 105*a*, 105*b*, and 105*c*. The size of the areas 105 may be adjusted because of the higher cumulative energy absorbed from the projectiles.

In some embodiments, each layer of the target 100 is manufactured with the thermally activated pigment mixed with the self-healing polymer or elastomer material to create a unitary layer that provides both the heat activated color changing and self-healing properties. In some embodiments, the thermally activated pigment is mixed into varying degrees of a heterogenous mixture. Thus, removing the need to coat the layer with the thermally activated pigment. This step typically occurs during the manufacturing process, allowing the incorporation of one or more thermally activated pigments to create different activations temperatures, or different activation colors.

The thermochromic pigment can be integrated into the target layer, applied as a laminate layer, or sprayed on to a compatible material.

In the depicted embodiment, the target layers are a polymer material. This provides an advantage over traditional paper and steel targets, such as the ability to sustain many rounds while substantially maintaining their structure, the ability to react without causing bullet fragmentation, especially critical at close ranges and indoors. Yet, even with the benefits of a polymer target, the primary inherent shortcoming of polymer targets is the difficulty in determining if the target was struck, and precisely where a shot hit, especially as the target becomes more used. This is due to the relatively small hole and potentially imperceptible physical reaction of the impacted target. Thus, the visual feedback properties of the target 100 allows for this shortcoming to be corrected and provide the advantages of a paper or metal target with the longevity of a polymer target.

With the thermally activated properties of the target 100, when the target 100 is struck by the projectile, the energy absorbed by target from the projectile activates the thermochromic pigment causing an area around the point of impact to change colors temporarily as the energy is absorbed by the target 100 and changes color back to the original color upon the release of the energy (e.g. reversible). The reversible thermochromic pigment provides the advantage of allowing the target 100 to be used numerous times without the need to replace the target 100, and also provide the advantageous visual indication of the hit. This provides a temporary visual indication of the point of impact. Once the target 100 returned to the ambient temperature, the visual indicator fades away and the target 100 returns to its original color. This allows for a hit in the same location to be registered, without any confusion as to which projectile caused the damage. With regular targets it is nearly impossible to identify if two shots hit the same point on the target. With the present invention, if two shots or projectiles hit the same spot on the target, the energy absorbed from the projectile would cause a visual alteration to the target that would be noticeable from the first projectile to the second projectile. For example, even if an area of the target is in an activated state, a new strike in substantially the same location would cause the area 105 to increase or change to another color as the total energy absorbed increases.

In another embodiment, the target 100 is constructed of a translucent polymer, incorporating a thermochromic pigment that is normally colored and appears clear in its activated state, such that the target 100 area surrounding 104 a projectile strike becomes temporarily translucent. When combined with a provision for bright or collimated light directed at the side of the target 100 opposite the shooter, the point of impact, now fully translucent, appears to actively glow, enabling or enhancing visibility of the hit, especially in low-light or long-distance situations.

Figure 6:
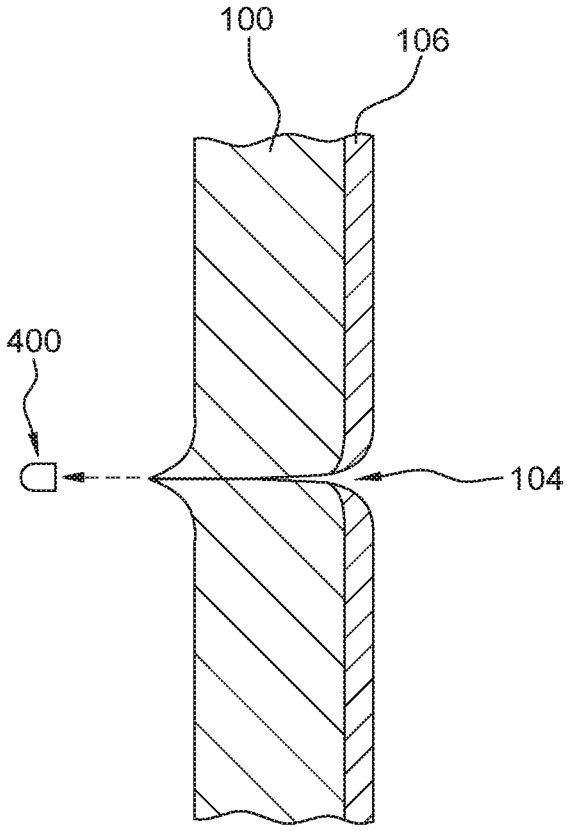
FIG. 6 depicts a cross section image of the target immediately after a projectile has passed through the target, in accordance with one embodiment of the present invention.

FIG. 6 depicts a cross section image of the target 100 after a projectile 400 has passed through the target, in accordance with one embodiment of the present invention. In the depicted embodiment, the target 100 is struck by projectile 400 and penetrated the target 100. As the projectile 400 passes through the target 100, the target heals the opening as shown. In the depicted embodiment, the pigment layer 106 is shown applied to the surface of the target 100. In some embodiments, the pigment layer 106 is mixed or integrated into the manufacturing of the target 100 to create a target where the pigment is substantially distributed through the target 100. In additional embodiments, multiple layers of pigment 106 may be applied to substantially the entire surface or sections of the target 100. In some embodiments, the various different pigments are mixed together to form a single layer 106 which is applied to the target 100 that has multiple activation temperatures.

In some embodiments, a UV protection layer may be applied to the target 100 to protect against long term exposure to UV radiation in sunlight and also provide protection from weather.

Through the use of various thermochromic pigment activation ranges, the target 100 can be designed to provide the visual indication of a hit in a variety of temperatures and settings. A target can be made to have a range of activation temperatures to allow for the use of the target indoors and outdoors, through the integration of more than one layer (or laminate) into the target 100.

For example, if the ambient temperature is greater than the activation temperature of the pigment in one layer of a target, that layer will not provide the visual indication of a hit, because it has already entered its activated state. With the use of an additional layer or laminate with a thermochromic pigment that has an activation temperature greater than ambient, this layer of the target can still indicate a hit in these conditions, enabling its usefulness in a wider range of climates.

In an additional embodiment, the layer may turn translucent when it has reached a temperature where a reversible thermochromic pigment is used in the layer. In some embodiments, the thermochromic pigment is irreversible once activated. In some embodiments, where more than one thermochromic pigment is used in the target, one thermochromic pigment may be reversible and one of the thermochromic pigments may be irreversible. With additional layers with higher activation temperatures, the target is still visible to the shooter, provides the visual indicator of the hit, and can be used in a multitude of different environments both indoors and outdoors. Upon a bullet strike, the inner layer pigment will be activated, illustrating the point of impact, and thus extending the useful temperature range of the target. As the temperature of the layer returned to the ambient temperature, the layer will return to its original color.

In some embodiments, there are two (2) different pigments blended together that are activated at different temperatures and have different colors when activated. For example, a first pigment which is active at 80 degrees, and a second pigment which is active at 100 degrees.

Various thermochromic pigment compositions of varying colors and activation temperatures can be employed based on the use of the target 100. For example, a single target may have two sides, wherein each side has two different thermochromic pigments, to provide a target that works in a significantly greater temperature range, due to 4 distinct activation temperatures.

Another embodiment involves blending two or more different thermochromic pigments into the base material of the layer. This would not require any lamination or coating of the layer and still provide the diverse range of activation temperatures. For example, a first thermochromic pigment could be black and activate to clear at 60 degrees Fahrenheit, where the second could be red and activate to yellow at 80 degrees Fahrenheit. In a 50-degree ambient, the target would appear black and a hit would appear red. That same target in a 70-degree ambient would appear red and a hit would appear yellow.

In another embodiment, a first thermochromic pigment could be blue with a first activation temperature, a second thermochromic pigment could be red with a second activation temperature which is greater than the blue layer's activation temperature, and the base color of the target 100 is yellow, and the target would appear purple in an ambient temperature below the lower activation temperature. When the target 100 is struck or enough thermal energy is absorbed by the target 100, the blue pigment turns clear, thereby showing a color of the mixture of the yellow base and red layers. Once the thermal energy absorbed by the target 100 exceeds the second activation temperature, the red layer goes clear and only the yellow base pigment is visible. Different activation temperatures for the target 100 are accessible to work in both a cold environment and a warm environment, so that the target 100 is not being "activated" by the ambient temperature in more cases, thereby making projectile hits visible.

The construction and manufacturing of the target is consistent with that of existing self-healing designs, with the addition of thermochromic pigment that can be incorporated in multiple ways. In one embodiment, blending of the thermochromic pigment or pigments with the base material at the time of molding, casting, or extruding. In another embodiment, blending the thermochromic pigment or pigments into a material that is laminated onto the base material for the purpose of reducing cost or providing a stronger base material. In yet another embodiment applying a coating containing the thermochromic pigment through painting or other means of application.

In additional embodiments, the pigment layer, may be a piezochromic material. FIGS. 2-5 show how the piezochromic material creates the visual feedback in a way similar to that of the thermochromic pigment. The piezochromic material or pigment incorporated into the target 100 or applied to the target 100, change colors when a predetermined amount of force (or greater than) is applied to the piezochromic material. For example, when a projectile comes in contact with the target 100, the force applied by the projectile activates the piezochromic material, if that pressure (e.g. shock, impact, strain, etc.) is above a predetermined activation value. The piezochromic material shifts from a first color to a second color, similar to that of the thermochromic pigment, thereby providing the visual feedback.

In some embodiments, multiple layers of piezochromic material are applied to the target 100 so that different types (e.g. caliber) of projectiles may activate different layers through the force applied to the target 100. For example a smaller caliber bullet may only exert enough force to activate a first layer of piezochromic material, where a larger caliber bullet may exert enough force to activate a second or third layer of piezochromic material, that has a higher force requirement to activate. In the preferred embodiment, the piezochromic material is reversible, where after either a predetermined time, or after the pressure applied to the piezochromic material has decreased below a predetermined threshold value, the color returns to its original inactivated state. In other embodiments, the piezochromic material may be irreversible based on the target 100 design and purpose.

A reversible piezochromic system exhibits a change in appearance after the pressure is applied to the target 100 and then after the pressure decreases. This change in appearance is similar to the demonstrated change in appearance in FIGS. 2-5. The change in appearance (e.g. color) is distinguishable from an original state prior to the external pressure being applied to the piezochromic material. After the pressure is removed and/or after a set relaxation time, the piezochromic material returns to its original appearance.

In some embodiments, the target 100 may have both thermochromic pigments and piezochromic material incorporated into the target 100. These embodiments provide the advantage of allowing the target 100 to have the visual feedback through the piezochromic material when the ambient temperature is outside of the ideal range for the thermochromic pigment to provide sufficient reaction to hit from a specific projectile.

While this invention has been described in conjunction with the specific embodiments outlined above, it is evident that many alternatives, modifications and variations will be apparent to those skilled in the art. Accordingly, the preferred embodiments of the invention, as set forth above, are intended to be illustrative, not limiting. Various changes may be made without departing from the spirit and scope of this invention.

What is claimed is:

1. A hit-indicating target comprising:

A self healing elastic polymer material, having a first side and a second side; and a first coating applied to at least the first side of the self healing elastic polymer material, wherein the first coating contains a visual indicating pigment and has a first activation energy, and the visual indicating pigment is activated in an area greater than the area in which an object comes in contact with the layer of polymer material, wherein the visual indicating pigment activates to a colorless state and the polymer is translucent allowing light to become visible through the layer of polymer material after the activation of the hit-indicating target.

2. The hit-indicating target of claim 1, wherein the first coating is a reversible thermochromic pigment, wherein the thermochromic pigment has a first activation temperature.

3. The hit-indicating target of claim 1, wherein the first coating is a piezochromic material, wherein the first coating has a first activation pressure.

4. The hit-indicating target of claim 3, wherein the piezochromic material is reversible.

5. The hit-indicating target of claim 1, further comprising a second coating of a visual indicating pigment applied to at least the first side of the layer of polymer material, wherein the second coating has a second activation temperature which is a different temperature compared to the first activation temperature of the first coating.

6. The hit-indicating target of claim 5, wherein the first coating and the second coating are mixed together to form a mixed layer with two distinct activation temperatures applied to the polymer material.

7. The hit-indicating target of claim 1, further comprising a third coating of UV resilient material is applied to the first coating.

8. The hit-indicating target of claim 7, wherein the third coating of UV resilient material is incorporated with the first coating forming a multipurpose layer applied to the polymer material.

9. The hit-indicating target of claim 1, further comprising a mounting system to secure the target to a support structure.

10. The hit-indicating target of claim 1, wherein the layer of polymer material, having a first side and a second side is a translucent polymer with a thermochromic pigment integrated with the translucent polymer.

11. The hit-indicating target of claim 10, wherein when the layer of polymer material is a first color and when activated becomes transparent.

12. A hit-indicating target comprising:

a layer of polymer material, having a first side and a second side, wherein the layer of polymer material has self-healing properties; and a first coating applied to at least the first side of the layer of polymer material, wherein the first coating contains a visual indicating pigment, wherein the visual indicating pigment activates to a colorless state and the polymer is translucent allowing a light to become visible through the layer of polymer material after the activation of the hit-indicating target.

13. The hit-indicating target of claim 12, wherein light would be visible through the polymer material when passing through the polymer material.

14. The hit-indicating target of claim 12, wherein the visual indicator pigment is a thermochromic material.

15. The hit-indicating target of claim 12, wherein the visual indicator pigment has a first color state and a second color state and is able to transfer between the first color state to the second color state based on an amount of energy absorbed or released from the polymer material.

* * * * *